US008978941B2

(12) United States Patent
Kim

(10) Patent No.: US 8,978,941 B2
(45) Date of Patent: Mar. 17, 2015

(54) RETAIL DISPLAY STRAP FOR ATTACHING AND DISPLAYING TWO ARTICLES OF CLOTHING

(75) Inventor: Cin Kim, Alpine, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 1019 days.

(21) Appl. No.: 13/021,396

(22) Filed: Feb. 4, 2011

(65) Prior Publication Data

US 2011/0192869 A1 Aug. 11, 2011

Related U.S. Application Data

(60) Provisional application No. 61/301,672, filed on Feb. 5, 2010.

(51) Int. Cl.

| | |
|---|---|
| ***A41D 27/22*** | (2006.01) |
| ***A47F 7/12*** | (2006.01) |
| ***A47F 5/00*** | (2006.01) |
| ***A47F 7/19*** | (2006.01) |

(52) U.S. Cl.

CPC ..... *A47F 7/12* (2013.01); *A47F 5/0006* (2013.01); *A47F 7/19* (2013.01)

USPC ..... 223/87

(58) Field of Classification Search

USPC ..... 223/85, 87, 88; 24/16 PB, 17 A, 17 AP, 24/17 R, 50

See application file for complete search history.

(56) References Cited

U.S. PATENT DOCUMENTS

| | | | | |
|---|---|---|---|---|
| 520,145 | A | | 5/1894 | Newman |
| 1,266,275 | A | | 5/1918 | Kelley |
| 1,719,618 | A | | 7/1929 | Novick |
| 1,829,613 | A | | 10/1931 | Ryuji |
| 1,986,649 | A | | 1/1935 | Warren |
| 2,004,098 | A | | 6/1935 | Andrews |
| 2,081,242 | A | | 5/1937 | Long |
| 2,156,583 | A | | 5/1939 | Chaplin |
| 2,204,004 | A | | 6/1940 | Steele |
| 2,286,181 | A | | 6/1942 | Steele |
| 2,321,147 | A | | 6/1943 | Kennedy |
| 2,910,214 | A | * | 10/1959 | Gouner ..... 223/87 |
| 3,069,009 | A | * | 12/1962 | Hoeflich ..... 206/284 |
| 3,370,765 | A | * | 2/1968 | Jossem ..... 223/87 |
| 3,611,597 | A | * | 10/1971 | Boyd ..... 223/84 |
| 3,662,434 | A | | 5/1972 | Clayton |
| 3,835,505 | A | | 9/1974 | Shewbridge |
| 3,942,192 | A | | 3/1976 | Harris |
| 3,978,593 | A | * | 9/1976 | Pulitzer et al. ..... 434/99 |

(Continued)

*Primary Examiner* — Nathan Durham

(74) *Attorney, Agent, or Firm* — Leason Ellis LLP

(57) ABSTRACT

In accordance with one embodiment, a display strap for displaying a first article of clothing (e.g., a tie) with a second article of clothing (e.g., a hanky, etc.) includes an elongated strap body having a first end and an opposing second end along with a top edge and an opposing bottom edge. The body has a plurality of score lines to permit the elongated body to be folded and the first end be drawn toward the second end. The body further has a locking slit formed therein proximate the first end and a locking tab formed at the second end for reception within the locking slit to form a continuous, folded strap body that captures the first and second articles of clothing for holding thereof at a first location. The display strap has a flag portion that extends upwardly from the top edge of the body and includes an opening formed therein for receiving a fastener that couples the first and second articles of clothing together at a second location that is spaced from the first location.

18 Claims, 3 Drawing Sheets

(56) References Cited

U.S. PATENT DOCUMENTS

| | | | | | |
|---|---|---|---|---|---|
| 3,997,943 | A | | 12/1976 | Jones et al. | |
| 4,189,049 | A | * | 2/1980 | Silver | 206/216 |
| 4,213,548 | A | | 7/1980 | Wood | |
| 4,466,159 | A | | 8/1984 | Burrage | |
| 4,601,417 | A | * | 7/1986 | Kunreuther | 223/85 |
| 4,942,644 | A | | 7/1990 | Rowley | |
| 5,014,957 | A | * | 5/1991 | Nichol, Jr. | 223/85 |
| 5,170,507 | A | | 12/1992 | Langford et al. | |
| 5,261,580 | A | * | 11/1993 | Smith | 223/85 |
| 5,289,619 | A | | 3/1994 | Pileggi | |
| 5,416,926 | A | | 5/1995 | Koy | |
| 5,983,461 | A | | 11/1999 | Chen | |
| 6,036,064 | A | * | 3/2000 | Tawil | 223/85 |
| 6,216,275 | B1 | | 4/2001 | Lee | |
| 6,510,590 | B1 | | 1/2003 | Lin | |
| 6,651,810 | B2 | * | 11/2003 | Nichol, Jr. | 206/297 |
| D630,126 | S | | 1/2011 | Kim | |
| 7,874,423 | B2 | * | 1/2011 | Chang | 206/292 |

* cited by examiner

RETAIL DISPLAY STRAP FOR ATTACHING AND DISPLAYING TWO ARTICLES OF CLOTHING

CROSS REFERENCE TO RELATED APPLICATIONS

The present application claims the benefit of U.S. patent application Ser. No. 61/301,672, filed Feb. 5, 2010, which is hereby incorporated by reference in its entirety.

TECHNICAL FIELD

The present invention relates to retail displays and in particular, the present invention relates to a retail display that is used to attach and display together two complementary articles of clothing.

BACKGROUND

Retailers are discovering that combinations of articles of clothing packaged together better meet the needs of a certain class of shoppers. When displaying and selling complementary articles of clothing, retailers assist their clients with a fashion choice that can be time consuming. Furthermore, when suitably coordinated, a combination of complementary articles of clothing can make a more attractive display item for sale than if displayed individually.

For example, besides a shirt and tie combination, complementary articles of clothing can include a tie and hanky or pocketsquare; a tie and jewelry accessories, such as cufflinks, etc.

It would therefore be desirable to provide a display article that assists the retailer in the display of two complementary articles of clothing and permits a single purchase at the retail site and likewise prevents a consumer from freely separating articles of clothing meant to be combined.

SUMMARY

In accordance with one embodiment, a display strap for displaying a first article of clothing (e.g., a tie) with a second article of clothing (e.g., a hanky, etc.) includes an elongated strap body having a first end and an opposing second end along with a top edge and an opposing bottom edge. The body has a plurality of score lines to permit the elongated body to be folded and the first end be drawn toward the second end. The body further has a locking slit formed therein proximate the first end and a locking tab formed at the second end for reception within the locking slit to form a continuous, folded strap body that captures the first and second articles of clothing for holding thereof at a first location. The display strap has a flag portion that extends upwardly from the top edge of the body and includes an opening formed therein for receiving a fastener that couples the first and second articles of clothing together at a second location that is spaced from the first location.

These and other aspects, features and advantages shall be apparent from the accompanying Drawings and description of certain embodiments of the invention.

DETAILED DESCRIPTION OF CERTAIN EMBODIMENTS OF THE INVENTION

Figure 1:
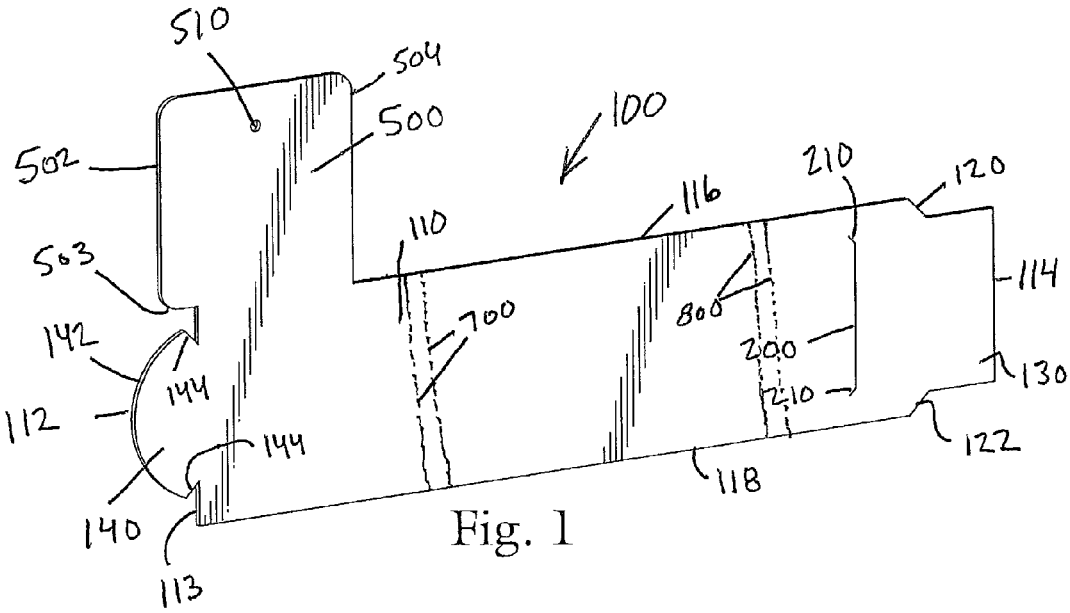
FIG. 1 is a front perspective view of a Retail Display Strap according to one embodiment showing the strap in an unfolded position.
Figure 2:
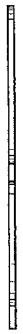
FIG. 2 is a left side elevation view thereof.
Figure 3:
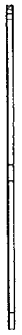
FIG. 3 is a right side elevation view thereof.
Figure 4:
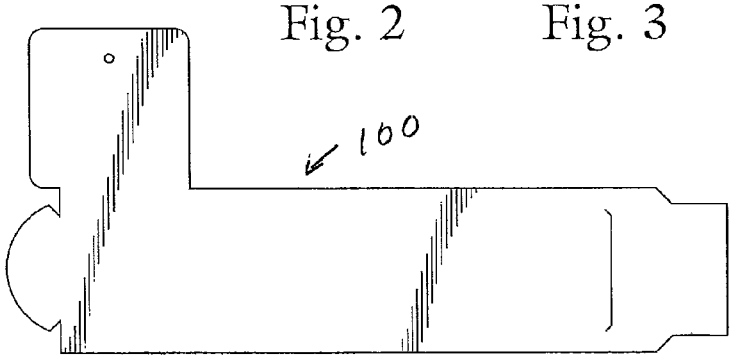
FIG. 4 is a front elevation thereof.
Figure 5:
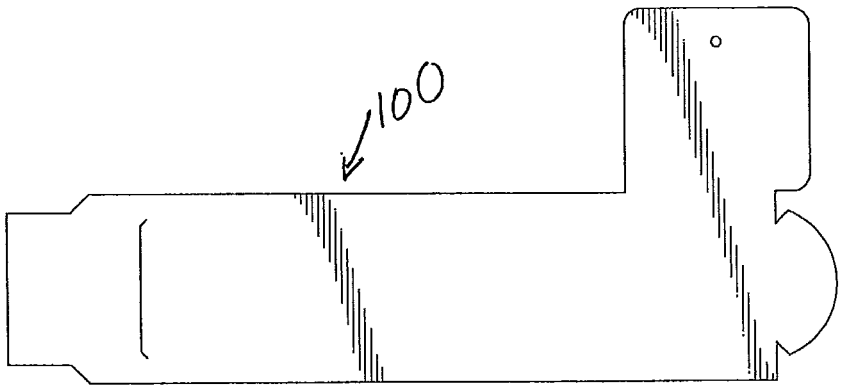
FIG. 5 is a rear elevation view thereof.
Figure 6:
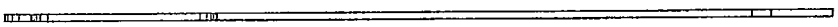
FIG. 6 is a top plan view thereof.
Figure 7:
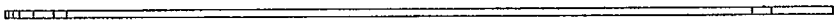
FIG. 7 is a bottom plan view thereof.

FIGS. 1-8 show a retail display strap 100 in accordance with one embodiment. The strap 100 is formed of a body 110 that has a first end 112 and an opposing second end 114 along with a top edge 116 and a bottom edge 118. Both the top and bottom edges 116, 118 are substantially planar, parallel edges with the exception of portions of these edges that terminate at the second end 114. More specifically, the strap 100 has a reduced width (the distance between the top and bottom edges 116, 118) at the second end 114 due to the top edge 116 and the bottom edge 118 each having an inwardly beveled edge portion 120, 122, respectively. The reduced width of the display 100 can be thought of as defining an end tab 130 or the like. The end tab 130 includes the second end 114 and is defined by the reduced width body. Within the end tab 130, the top and bottom edges 116, 118 are planar, parallel edges so that the end tab 130 has a uniform width.

The display 100 also includes a locking slit 200 that is formed in the body proximate the second end 114. The slit 200 is closer to the first end 112 than the inwardly beveled edge portions 120, 122 and thus, the slit 200 is not located within the reduced width portion but rather is located in the wider portion of the display 100. The slit 200 runs substantially transversely across the display 100 between the top and bottom edges 116, 118. In other words, the slit 200 runs substantially perpendicular to the top and bottom edges 116, 118. The ends of the slit 200 can include angled slit sections 210 to allow the slit 200 to be more easily opened (e.g., by lifting the slit 200 relative to the surrounding portions of the display).

At the first end 112, the display 100 includes a locking tab 140. The locking tab 140 extends outwardly and includes an arcuate outer edge 142 that defines the first end 112. The arcuate outer edge 142 is joined to the body of the display 100 by a pair of inwardly beveled, cut edges 144 that intersect an end wall 113 of the body 110 (the end wall 113 is perpendicular to the top and bottom edges 116, 118). The outer edge 142 assumes a convex shape and the presence of the cut edges 144 permit the locking tab 140 to be bent or folded or otherwise manipulated.

It will be appreciated that the body 110 has a surface area 112 that is available for placement of indicia, such as a product name or logo, corporate name or logo, a design or any other content that is to be delivered to a prospective consumer.

Figure 8:
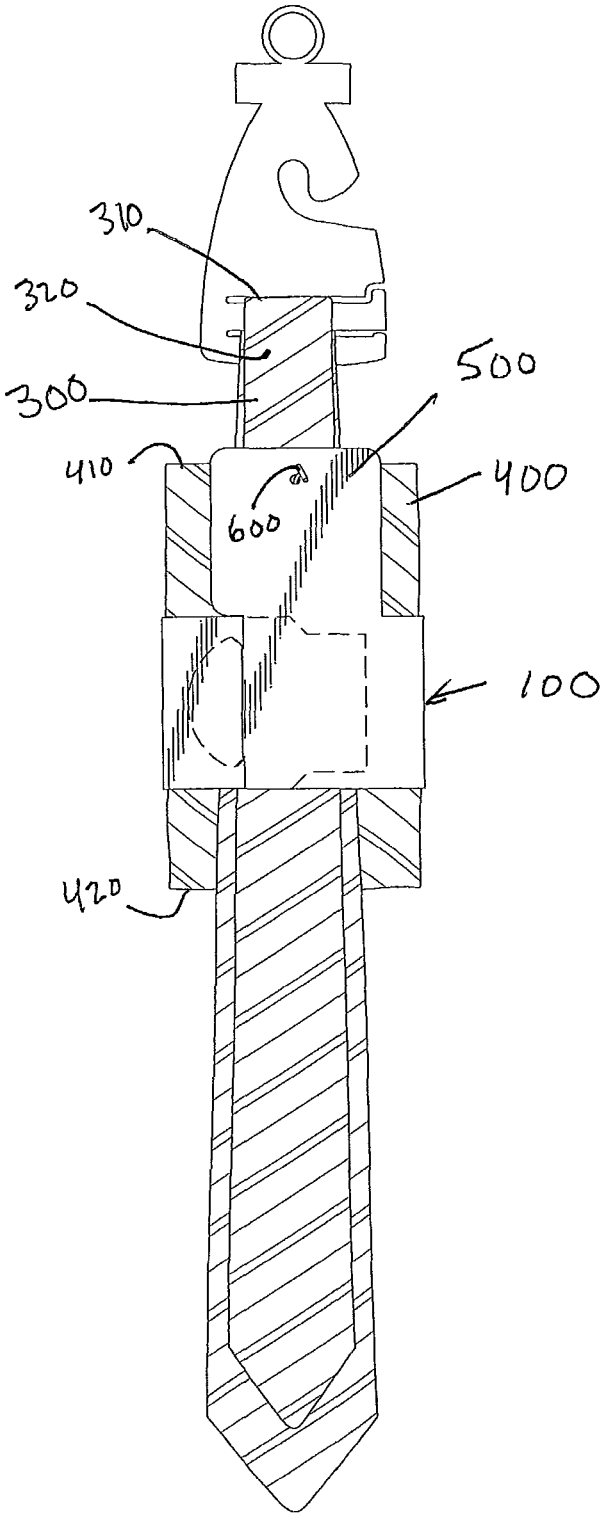
FIG. 8 is a rear elevation view of the Retail Display Strap of FIG. 1 in an assembled, folded position.

As discussed in more detail below, the body 110 represents a first means for securely coupling two articles of clothing together and more particularly, the locking tab 140 and the locking slit 200 represent the first coupling means. In FIG. 8, the body 110 is shown coupling a first article of clothing 300 to a second article of clothing 400. For example, the first article of clothing 300 is a tie and the second article of clothing 400 is a hanky; however, other articles can be used with the display 100, such as a pocket square, a paper (cardboard) display including accessories, such as jewelry.

In accordance with the present invention, the display strap 100 includes a top tab or flag portion 500 that extends upwardly from the top edge 116 of the main body 110. As discussed in more detail below, the flag portion 500 serves as a second coupling means for securely attaching the first and second articles of clothing 300, 400. In particular, the flag portion 500 is intended to overlie portions of the first and second articles of clothing 300, 400 that themselves overlie one another.

The flag portion 500 is preferably integrally formed (e.g., be formed as the same part) as the body portion 110. The flag portion includes a first side edge 502 and an opposing second side edge 504 both of which are perpendicular to the top edge 116. A bottom corner 503 of the first side edge 502 is curved and is located beyond the end wall 113 of the body 110.

The flag portion 500 includes an opening 510 formed therein for receiving a fastener 600 for attaching the first and second articles of clothing 300, 400 to one another. For example, the fastener 600 can be a plastic barb 600. It will be appreciated and more apparent from the below discussion that the combination of the first coupling means and the second coupling means permits the two articles of clothing 300, 400 to be properly positioned relative to one another and securely attached in the desired relative position. The flag portion 500 also provides a surface on which additional indicia can be displayed.

In the illustrated embodiment, the flag portion 500 has a generally rectangular shape; however, the flag portion 500 is not limited to this shape and can assume and number of other types of shapes, including but not limited to circular, square, triangle, oval, etc.

The manner of applying the display 100 to the first and second articles of clothing 300, 400 is now described.

In the illustrated embodiment, the first article of clothing 300 is a tie and the second article of clothing 400 is a hanky. The tie 300 is once folded along a fold line 310 such that the two pointed ends of the tie 300 are proximate one another. The hanky 400 is likewise folded along a plurality of fold lines so that it assumes a rectangular folded structure.

To couple the tie 300 to the hanky 400, the folded tie 300 is positioned so that a folded portion 320 of the tie 300 extends above a top edge 410 of the folded hanky 400. More specifically, the fold line 310 is located above the top edge 410 of the folded hanky 400. The folded tie 300 extends lengthwise along the folded hanky 400 with the loose ends of the tie 300 being located well below a bottom edge 420 of the folded hanky 400.

In order to assist in the folding of the display 100, the body 110 can include two pairs of score lines 700, 800 that permit the folding of the display 100. The first pair 700 is closely spaced relative to one another and is located closer to the first end 112, while the second pair 800 are closed spaced relative to one another and are located closer to the second end 114. The body 110 is first laid underneath the folded hanky 400 (along the front surface thereof where the tie 300 is not present) and is then folded about the two pairs of the score lines 700, 800 such that first and second ends 112, 114 are brought to one another. The locking tab 140 is then inserted into the locking slit 200.

The end wall 113 of the body 110 lies outside the slit 200 and abut thus limits and properly positions the locking tab 140 within the locking slit 200. When the two opposing ends of the body 110 are fastened to one another, the bottom corner 503 of the first side edge 502 lies at or above the top edge of the body 110.

When the body 110 assumes the folded, locked position, the flag portion 500 lies centrally over the folded tie 300 and hanky 400 to allow the plastic barb 600 to be inserted through both the folded tie 300 and the hanky 400 to effectively couple the two items together at a second location that is proximate the first coupling location where the folded, locked body 110 serves to couple the two items together.

When the items 300, 400 are arranged relative to one another, the flag portion 500 will lie on the rear or backside of the overlying, folded items outside of the view of the consumer.

Optionally, to additionally secure the folded body 110 together, an adhesive member, such as a sticker, can be used along the interface between the slit 200 and the portion of the body 110 received therein.

As shown in FIG. 8, it will be appreciated that the folded portion 320 of the folded tie 300 that extends above the top edge 410 of the folded hanky 400 provides a structure to allow the coupled the attached tie 300 and hanky 400 to be hung and displayed by use of a hanger 800 that includes a hook member 810 and at least one finger 820. To hang the tie/hanky combination, the finger 820 is received within the folded portion 320, thereby allowing the top edge of the hanky 400 to lie below the hanger 800 and to allow the combined tie/hanky combination to be prominently displayed.

The present invention thus provides a means for securely locating and holding two articles of clothing relative to one another to permit a proper, pleasing display of these items, while also preventing a consumer from easily separating the items. The consumer can thus purchase the combined articles.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A display strap for displaying a first article of clothing with a second article of clothing comprising:

an elongated strap body having a first end and an opposing second end along with a top edge and an opposing bottom edge, the body having a plurality of score lines to permit the elongated body to be folded and the first end be drawn toward the second end, the body further having a locking slit formed therein proximate the first end and a locking tab formed at the second end for reception within the locking slit to form a continuous, folded strap body that captures the first and second articles of clothing for holding thereof at a first location; and a flag portion that extends upwardly from the top edge of the body and includes an opening that is completely bounded and spaced from peripheral edges of the flag portion, wherein the opening receives a fastener that couples the first and second articles of clothing together at a second location that is spaced from the first location, wherein the fastener passes transversely through the first and second articles of clothing and transversely through the opening formed in the flag portion;

wherein the flag portion includes a first side edge and a second side edge that is joined to the top edge of the body, the first side edge being free of being joined to the top edge.

2. The display strap of claim 1, wherein the flag portion is integrally formed with the body portion both of which are formed of a paper material.

3. The display strap of claim 1, wherein the first end of the body is disposed underneath a portion of the folded body that terminates at the second end.

4. The display strap of claim 1, wherein the fastener comprises a plastic barb that passes through the first and second articles of clothing.

5. The display strap of claim 1, wherein the continuous, folded strap body has a rectangular shape.

6. The display strap of claim 1, wherein the first side edge lies above the locking tab and is spaced therefrom and free of attachment thereto.

7. The display strap of claim 1, wherein the first article of clothing is a folded tie and the second article of clothing is a folded hanky.

8. The display strap of claim 7, wherein the folded tie is folded about a fold line and the hanky is folded along a plurality of fold lines.

9. A hangable retail display comprising:

a first article of clothing;

a second article of clothing;

a display strap for coupling and displaying the first article of clothing with the second article of clothing, the display strap including:

an elongated strap body having a first end and an opposing second end along with a top edge and an opposing bottom edge, the body having a plurality of score lines to permit the elongated body to be folded and the first end be drawn toward the second end, the body further having a locking slit formed therein proximate the first end and a locking tab formed at the second end for reception within the locking slit to form a continuous, folded strap body that captures the first and second articles of clothing for holding thereof at a first location, wherein the continuous, folded strap body has a bottom opening defined completely by the bottom edge and through which the first and second articles of clothing pass such that the first and second articles of clothing are disposed below the bottom edge; and a flag portion that extends upwardly from the top edge of the body and includes an opening formed therein for receiving a fastener that couples the first and second articles of clothing together at a second location that is spaced from the first location;

wherein the first article of clothing includes a folded portion that extends above a top edge of the second article of clothing and above the flag portion for coupling to a hanger to hang the combined and joined first and second articles of clothing; and wherein the flag portion includes a first side edge and a second side edge that is joined to the top edge of the body, the first side edge being free of being joined to the top edge.

10. The retail display of claim 9, wherein the first article of clothing is a folded tie and the second article of clothing is a folded hanky.

11. The retail display of claim 10, wherein the folded portion of the tie extends above the top edge of the folded hanky, with free ends of the tie lying below a bottom edge of the folded hanky.

12. The retail display of claim 9, wherein the fastener comprises a plastic barb that passes through the first and second articles of clothing.

13. The retail display of claim 9, wherein the continuous, folded strap body has a rectangular shape.

14. The retail display of claim 9, wherein the first side edge lies above the locking tab and is spaced therefrom and free of attachment thereto.

15. The retail display of claim 9, further including a hanger that includes a hook member and a finger, wherein the folded portion receives the finger underneath the fold line resulting in the combined first and second articles of clothing being hung from the hanger.

16. The retail display of claim 9, wherein the opening is completely bounded and spaced from peripheral edges of the flag portion, wherein the fastener passes transversely through the first and second articles of clothing and transversely through the opening formed in the flag portion.

17. A display strap for displaying a first article of clothing with a second article of clothing comprising:

an elongated strap body having a first end and an opposing second end along with a top edge and an opposing bottom edge, the body having a plurality of score lines to permit the elongated body to be folded and the first end be drawn toward the second end, the body further having a locking slit formed therein proximate the first end and a locking tab formed at the second end for reception within the locking slit to form a continuous, folded strap body that captures the first and second articles of clothing for holding thereof at a first location; and a flag portion that extends upwardly from the top edge of the body and includes an opening formed therein for receiving a fastener that couples the first and second articles of clothing together at a second location that is spaced from the first location, wherein the flag portion is formed at the second end of the strap body directly above the locking tab such that a gap is formed between the locking tab and a bottom edge of the flag portion.

18. The display strap of claim 17, wherein a height of the elongated strap is selected such that when the locking tab mates with the locking slit to form the continuous, folded strap body, the top edge of the strap body is disposed adjacent the bottom edge of the flag portion.

* * * * *